United States Patent [19]

Trp et al.

[11] 4,217,062

[45] Aug. 12, 1980

[54] PAINT FEEDING APPARATUS IN COMBINATION WITH A FOUNTAIN TYPE PAINT ROLLER

[76] Inventors: Peter Trp, 32-77 32nd St., Astoria, N.Y. 11106; Mile Lipovac, 32-58 37th St., Astoria, N.Y. 11103; Rodolfo Ribich, deceased, late of Astoria, N.Y.; by Virginia Ribich, legal representative, 23-32 31st Rd., Astoria, N.Y. 11106

[21] Appl. No.: 881,585

[22] Filed: Feb. 27, 1978

[51] Int. Cl.[3] ..... B05C 1/10

[52] U.S. Cl. ..... 401/44; 401/46; 401/197; 401/203; 417/477

[58] Field of Search ..... 401/44, 45, 46, 47, 401/130, 188 R, 197, 203, 204; 417/474, 475, 476, 477

[56] References Cited

U.S. PATENT DOCUMENTS

| | | | |
|---|---|---|---|
| 459,053 | 9/1891 | Truax | 417/477 |
| 487,136 | 11/1892 | Truax | 417/477 |
| 1,741,070 | 12/1929 | Oliveras | 417/477 |
| 3,143,756 | 8/1964 | Sisko | 401/188 |
| 3,457,017 | 7/1969 | Bastian | 401/197 X |
| 3,737,251 | 6/1973 | Berman et al. | 417/475 X |
| 3,977,797 | 8/1976 | Paterson | 401/188 R X |

FOREIGN PATENT DOCUMENTS

| | | | |
|---|---|---|---|
| 1528964 | 6/1969 | Fed. Rep. of Germany | 417/474 |
| 99312 | 11/1961 | Norway | 401/46 |

*Primary Examiner*—Paul T. Sewell

[57] ABSTRACT

An apparatus into which a can of paint is placable, the apparatus including a motor driven pump that draws the paint from the can and through a hose into the interior of a paint roller from where it filters through the roller and upon its outer surface so to be applied to any surface being painted, the roller including a perforated hollow cylinder covered by lamb wool on its outer side so the paint can soak therethrough; and the apparatus in a modified design being developed to deliver paint in a controlled manner from two paint cans to a common paint roller.

6 Claims, 16 Drawing Figures

PAINT
M

Fig. 10
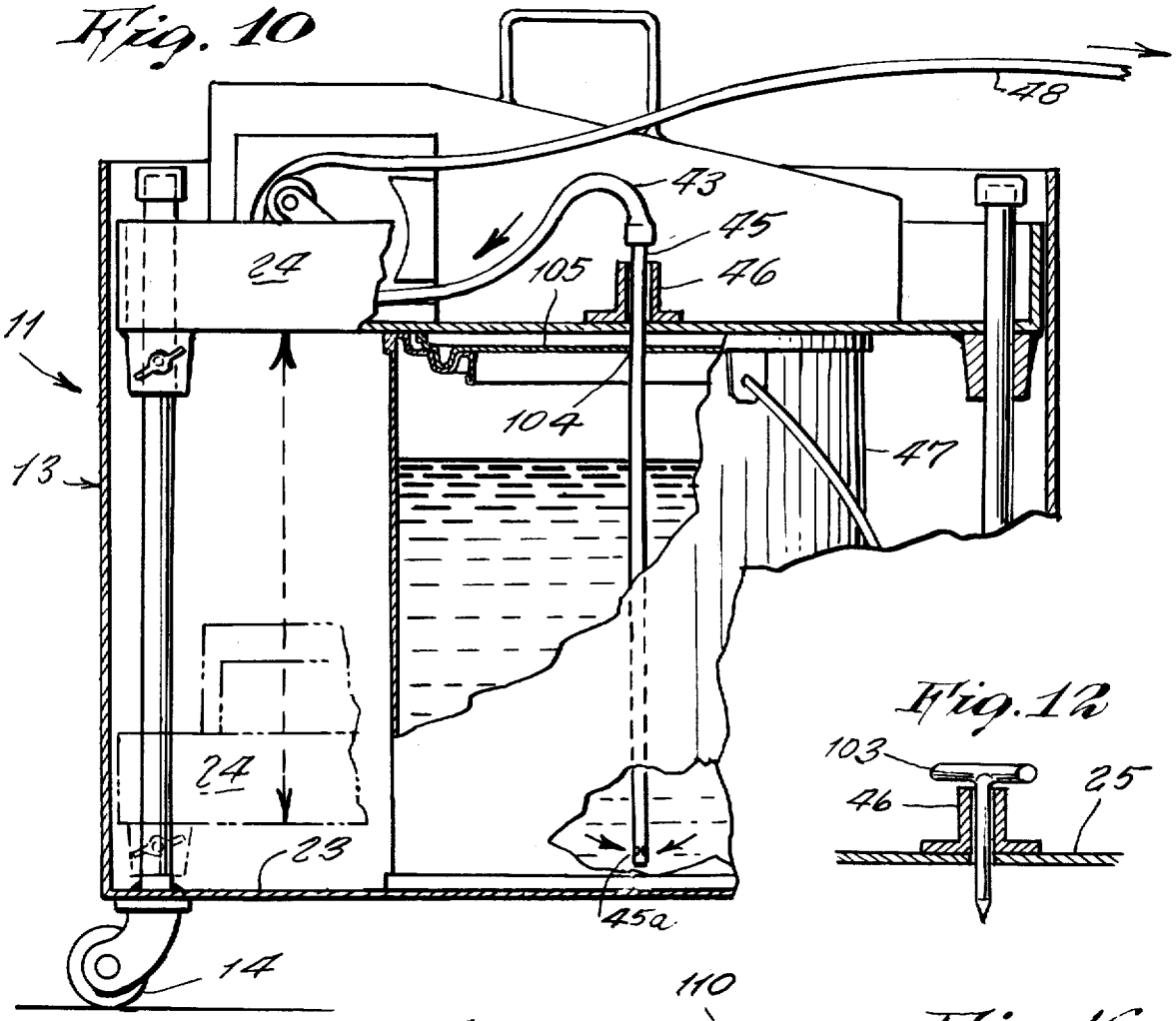
Fig. 12
Fig. 11
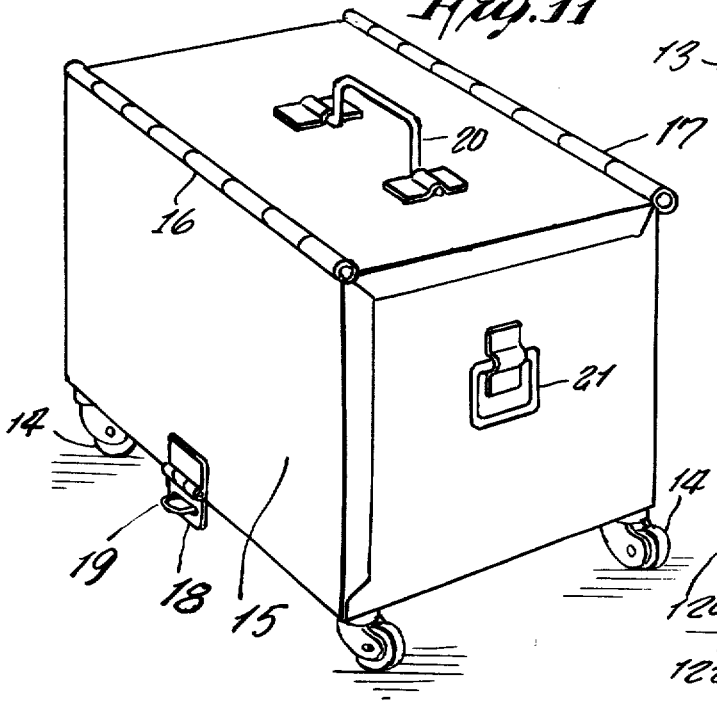
Fig. 16
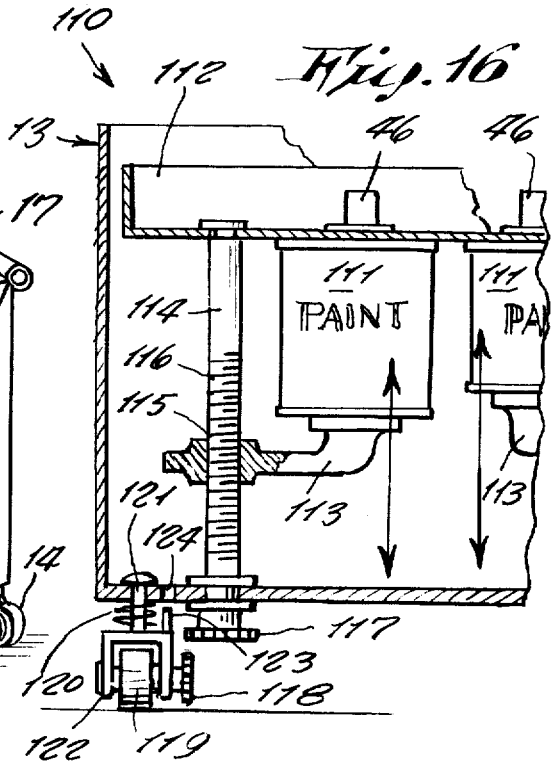

PAINT FEEDING APPARATUS IN COMBINATION WITH A FOUNTAIN TYPE PAINT ROLLER

This invention relates generally to paint rollers. More specifically it relates to a paint roller associated with a paint pumping apparatus.

A principal object of the present invention is to provide a paint roller and paint feeding apparatus combination wherein paint is automatically fed from a paint can directly to the paint roller so that a painting operation can be continuously performed without the necessity of stopping so to dip the roller into a paint tray and refill the roller with a new supply of paint.

Another object accordingly is to provide a paint roller and paint feeding apparatus combination which saves time to complete a painting job and thus also saves on labor costs.

Still another object is to provide a paint roller and paint feeding apparatus combination which is cleaner as it eliminates need of transfering a paint-loaded roller from a tray to a painting surface at which time there often occurs some paint dripping.

Still another object is to provide a paint roller and paint feeding apparatus combination wherein the principals of the present invention may be readily applied to a paint brush combined with the paint feeding apparatus.

Still another object is to provide a paint roller and paint feeding apparatus combination which in a modified design is adaptable to pump paints from a plurality of different paint cans and to a common paint roller so that a blend of paints can be applied at a same time.

Still a further object is to provide a paint roller and paint feeding apparatus combination in which movement of the apparatus upon its caster wheels is utilized for relatively easily tightening the paint cans in a firm position upon the apparatus.

Other objects are to provide a paint roller and paint feeding apparatus combination which is simple in design, inexpensive to manufacture, rugged in construction, easy to use and efficient in operation.

These and other objects will be readily evident upon a study of the following specification and the accompanying drawing wherein:

FIG. 10 is a front view of the paint feeding apparatus shown partly in cross section and showing the device with a paint can installed therein with the tray resting thereupon.

FIG. 11 is a perspective view of the paint feeding apparatus shown closed and ready for being transported.

FIG. 12 is a detail of a portion of FIG. 10 and showing the can punch stored inside sleeve mounted upon the tray.

FIG. 16 is a cross sectional view similar to FIG. 10, shown fragmentarily, and illustrating a modified design thereof.

Figures 7, 8, 9, 13, 14, 15:
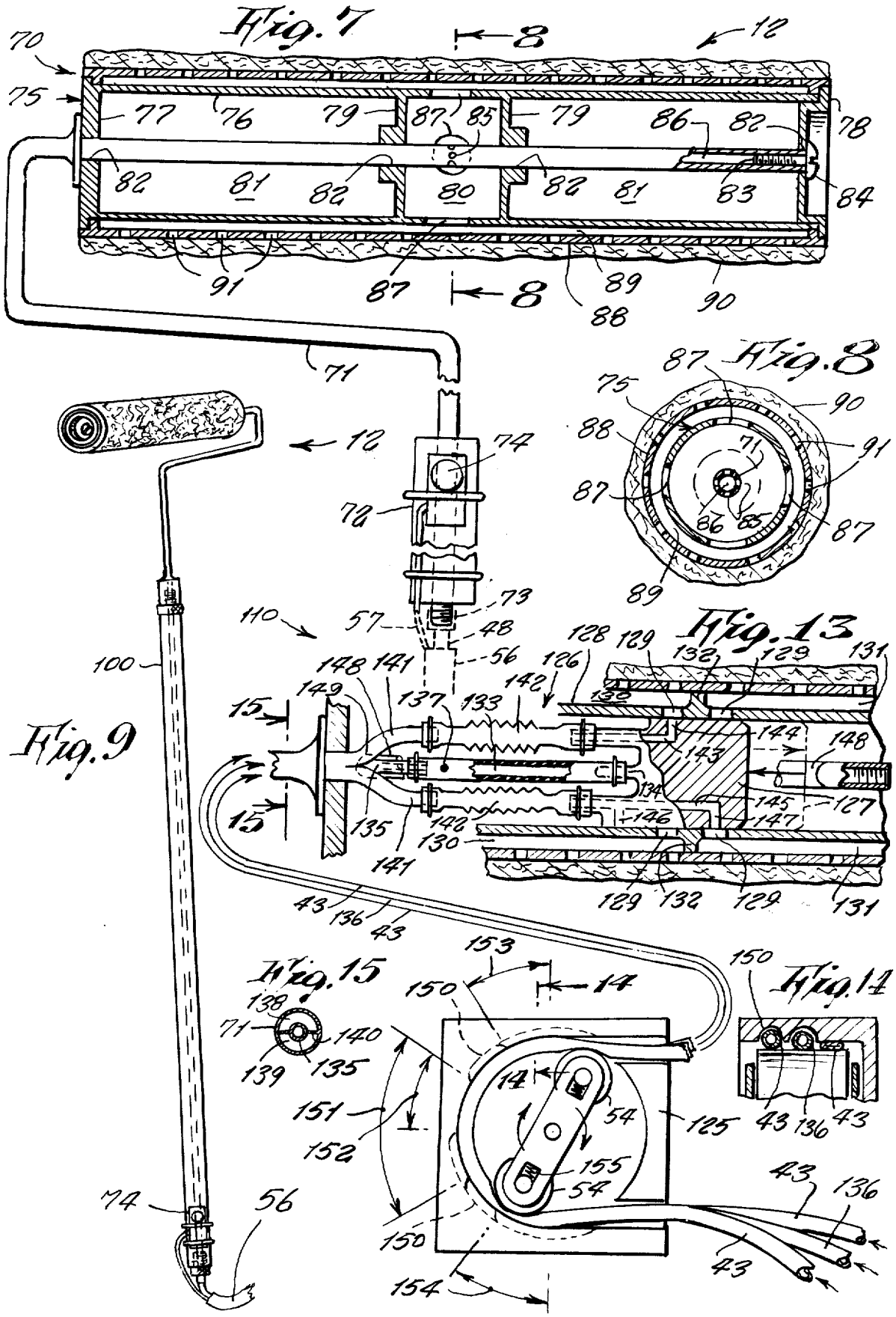
FIG. 7 is a cross sectional view of a paint roller associated with the above indicated apparatus.
FIG. 8 is a cross sectional view taken on line 8—8 of FIG. 7.
FIG. 9 is a perspective view of a modified design of the paint roller mounted upon an extension handle.
FIG. 13 is a diagrammatic view illustrating a side elevation of a modified design of pump connected by a plurality of paint-feeding tubes to a modified design of paint roller, shown fragmentarily and in cross-section.
FIG. 14 is a cross sectional view taken on line 14—14 of FIG. 13.
FIG. 15 is an enlarged cross sectional view taken on line 15—15 of FIG. 13.

Referring now to the drawing in detail, and more particularly to FIGS. 1 through 9 thereof at this time, the reference numeral 12″ represents a paint roller and paint feeding apparatus combination according to the present invention wherein there is a paint feeding apparatus 11 (shown in FIGS. 1 through 6) and a paint roller 12 (shown in FIGS. 7 through 9).

The apparatus 11 includes a case 13 made of strong sheet metal and which is mounted on caster wheels 14 so it can be rolled across a floor or ground. The case can be opened up by means of a door 15 that wraps around a top and front of the case, so to form a top wall and front wall thereof; the top and front walls comprising flat metal panels pivotally attached together by a hinge 16, while the door is pivotally hinged to an upper rear edge of the case by a hinge 17, A hasp 18 on the door engages a staple 19 on a lower front edge of the case so to receive a padlock and thus retain the case closed. Handles 20 and 21 are provided on the case and door so the closed case can be conveniently carried in the hands.

Inside the case, four posts 22 made of pipe are secured at their lower ends to a bottom wall 23 of the case, the posts extending upward so to abut against the underside of the top wall when the case is closed. A tray 24 has four openings through its bottom wall 25, the openings being near the tray corners and the posts 22 being inserted therethrough. Sleeves 26 secured to the underside of the tray receive the posts therethrough, each sleeve having a winged set screw 27 so to hold to the posts, thus permitting the tray to be secured to the posts at any desired elevation, as shown in FIG. 1.

Upon the tray there is mounted a paint pumping mechanism 30 including an electric motor 31 driving (by means of an endless belt 32 around pulleys 33 and 34) a paint pump 40.

Figures 1, 2, 3, 4, 5, 6:
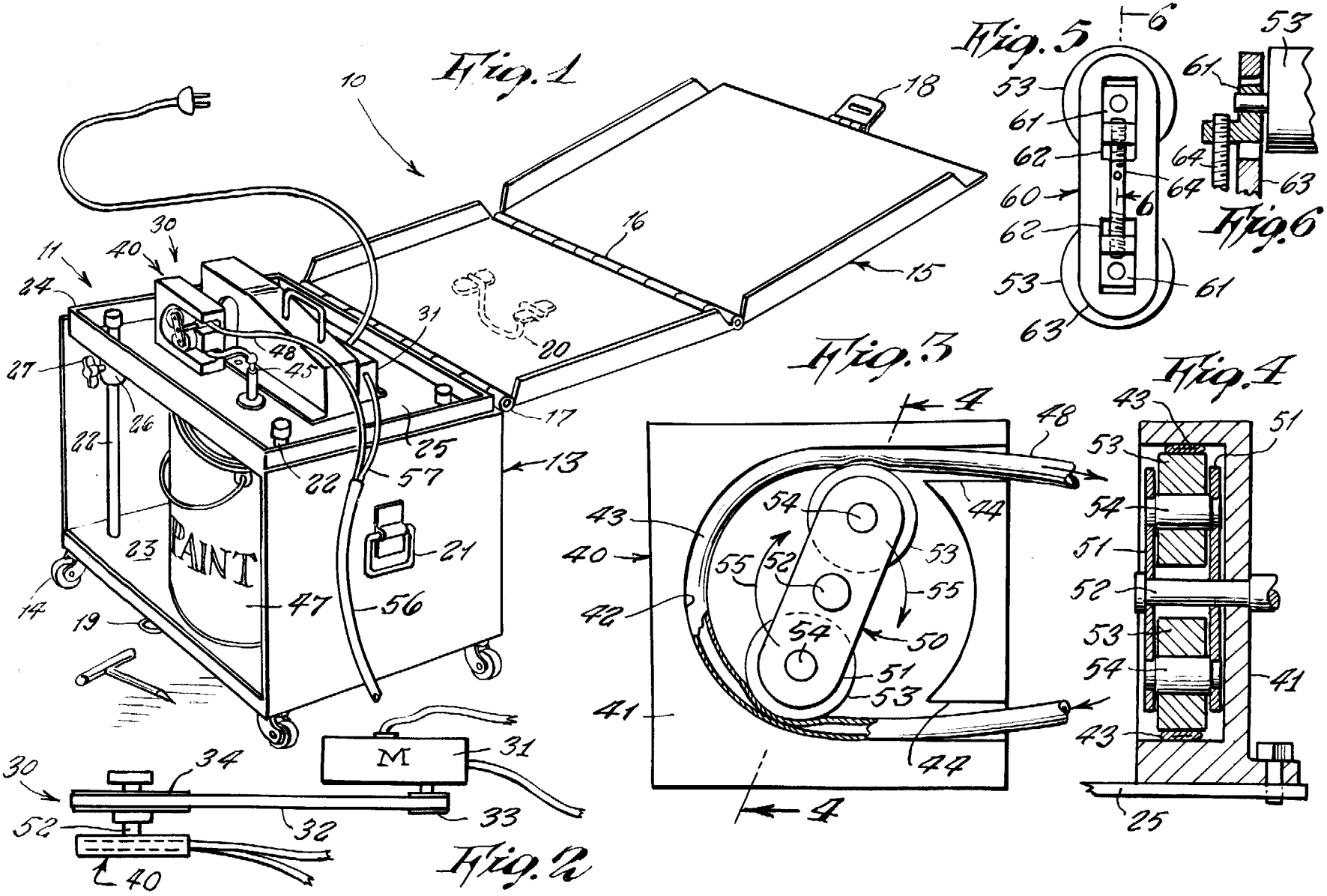
FIG. 1 is a perspective view of the paint feeding apparatus.
FIG. 2 is a top view of the apparatus drive.
FIG. 3 is a front view of a paint pump thereof.
FIG. 4 is a cross sectional line taken on line 4—4 of FIG. 3.
FIG. 5 is a front view of a modified design of the pump mechanism which is adjustable.
FIG. 6 is a fragmentary side cross sectional view thereof taken on line 6—6 of FIG. 5.

The paint pump 40 shown in FIGS. 3 and 4 includes a case 41 having a circular depression 42 on one side of the case. A flexible hose 43 of transparent plastic rests against the inner periphery of the depression through tangential grooves 44 outwardly of the case 41. One end of the hose 43 is connected to an upper end of a metal tube 45 which is inserted through a sleeve 46 mounted upon the tray bottom wall 25, the lower end of the metal tube being inserted into a paint can 47 of paint placed upon the case bottom wall 23 and underneath the tray 24. It is to be noted, as shown in FIG. 10, that several sideward openings **45*a* are provided near a lower end of the tube 45 so to admit paint into the tube. The other hose end 48 of the hose 45 leads to a paint roller 12, shown either in FIG. 7 or 9**.

The pump 40 includes an arm 50 rotatable within the center of the depression 42. The arm includes spaced apart levers 51 affixed at their longitudinal centers upon a shaft 52 which is secured to pulley 34. Between each of the ends of the levers there is a roller 53 mounted rotatable free on a pin 54 supported at their ends in the levers. The rollers 53 squeeze the hose 43, as shown in FIGS. 3 and 4, thus pushing the paint through the hose as the arm rotates in the direction indicated by arrows 55, and pump the paint from the can 47 to the roller 12.

In FIGS. 5 and 6, a modified design of paint pump arm is shown that is manually adjustable to squeeze the hose 43 more or less so to control the volume and rate of paint flow. Arm 60 differs from arm 50 by additionally including the rollers 53 being journaled in blocks 61 rather than directly in the levers, as indicated above. The blocks are slidable in grooves 62 of the levers 63. A turnbuckle threaded shafts 64 engages threadingly both blocks, so that by rotating the shaft 64, the blocks can be brought closer together or further apart.

The Paint roller 12 shown in FIG. 7 includes a roller assembly 70 supported rotatably free on one end of tubular metal rod 71, the other end of the rod 71 being inserted through a tubular handle 72, and the other end of the rod has a fitting 73 for being connected to the end 48 of the hose 43. A push button of a switch 74 on the outer side of the handle can be depressed by a thumb of a person holding the handle 72 in his hand so to open or close an electric circuit to the motor 31 so to control the paint output.

The end 48 of the hose 43 is formed into a cable 56 together with an electric cable 57 that extends from the motor 31 to switch 74.

The roller assembly 70 includes a hollow hard plastic inner cylinder 75 formed having a cylindrical side wall 76 and one circular end wall 77 integrally formed. A removable end cap 78 of hard plastic fits on the open end of the cylinder. A pair of circular, spaced apart partitions 79 inside the cylinder divide the cylinder interior into a central chamber 80 and opposite end chambers 81. A central opening 82 is formed through the end wall 77, the partitions 79 and 78 so that the rod 71 can be inserted therethrough. A screw 83 is screwed into the threaded end of the rod 71. An enlarged head 84 of the screw holds against the end cap thus holding the assembly 70 on the rod.

The rod has four radially extending holes 85 along its portion that is positioned within the central chamber 82, the holes 85 communicating with a central axial opening 86 that communicates with hose 43, so that paint enters the chamber 82, Four openings 87 through the cylindrical wall 76 allow the paint to then flow outward of the central chamber 80.

The assembly 70 also includes a hard plastic sleeve 88 fitted around the outer side of the cylinder 75 so that there is a space 89 therebetween and into which the paint thus flows when passing through openings 87. The sleeve 88 has lambs wool 90 mounted around its outer side, and the sleeve has perforated openings 91 therethrough so that the paint can then flow through the perforated openings and soak through the lambs wool to the outer side thereof so it can be applied to any surface being painted and against which the lambs wool is rolled. It should be understood that any appropriate synthetic material may be used in place of lambs wool.

In FIG. 9 the roller 12 is mounted on a handle extension 100 so that it can raise painting surfaces that are high up. In this case, the push button switch 74 for controlling motor 31 is located at a lower end of the handle so to be near the thumb of the holding hand. The extension 100 is tubular to carry the paint therethrough. All connections may be screw threaded for making leak proof joints.

Punch 103 serves to punch out hole 104 in can lid 105 so the hose end 45 can hang down into the can.

Reference is now made in greater detail to FIGS. 13 through 16 wherein there is shown a modified design of the present invention 110 wherein the same is designed particularly for pumping paints from a plurality of paint cans and dispensing the same to a common paint roller where the heretofore unmixed paints can be rolled on a surface that is being painted, so that the paints thus applied, produce a tie-die type of painted surface whereing random spots or splotches of the different colors appear next to each other without any specific pattern, such as the new trend in modernistic painted walls and ceilings that appeal to those persons who are unconventional.

In this design, two paint cans 111, each containing a different colored paint, is mounted inside the case 13, and tray 112 by means of a clamp arm 113 supported on a post 114 that is vertically adjustable so that dis-similar sizes of cans may be used at a same time. The tray 112 differs from tray 24 by having a plurality of sleeves 46 around a hole through the tray bottom wall. Each post 114 differs from above described posts 22 by being rotatable in order that the clamp arm 113 is vertically adjusted.

The clamp arm includes a threaded opening 115 engaging a screw thread 116 around the post 114. Thus rotation of the post causes the clamp arm to move against the underside of a can so to firmly lock the can against the underside of the tray.

In order that the post 114 is quickly and easily rotated, a gear 117 at a lower end of the post is engagable with a gear 118 affixed on a shaft of a caster wheel 119. Engagement of the gears is made possible when a downward force is manually applied against the case 13 so to compress a compression coil spring 120 around a spindle 121 of the caster 122, thus lowering the gear 117 so to engage the gear 118. At a same time an upward pin 123 on the caster enters a hole 124 through a bottom wall of the tray, so to prevent the caster to rotate freely about spindle 121. Thus in this position, when the case is given a push so to travel a short distance across a floor, the gear transmission causes the post to rotate so to lock the clamp arm strongly against the bottom of the paint can and firmly hold it against the underside of the tray bottom.

It is to be noted that the weight of the case, even when loaded with full paint cans, is insufficient so to compress the spring 120, and only a manual force downward by a person against the case will cause the spring compression so that the gears engage.

In this design, each paint can has its own hose 43 extending through one paint pump 125 and to one paint roller 12, as shown in FIG. 13.

Accordingly the pump 125 is a same as pump 40, except that it is made wider so as to accomodate several of the hoses 43 to extend therethrough; the hoses being aligned adjacent each other so that the rollers squeeze all of the hoses, in order to move the various colored paints up to the paint roller.

In this design, a means is also included so that each of the paints is intermittantly discharged into the paint roller, and also at alternate intervals into opposite ends of the paint roller, so that these spots of different colors are unpredictably painted along various positions of the paint roller.

A mechanism 126 serves to deliver the various paints at alternate intervals into the opposite ends of the paint roller.

The mechanism 126 includes a piston 127 slidable reciprocally back and forth inside a paint roller cylinder 128. The piston has paint outlets that selectively align with discharge outlets 129 through the cylinder, so to deposit the paints into chambers 130 and 131 which are separated from each other by a partition 132 formed around the outer side of the cylinder, so that paint in one cylinder is kept from going into the other.

Riciprocal movement of the piston is accomplished by a stretchable rubber tube 133 secured at one end on a projecting pin 134 of the piston, and which at its other end is connected to a metal tube 135 through which air is delivered into the tube 133 so to cause it to reciprocally stretch and constract, thus causing the piston to slide back and forth. The tube 135 extends through a center of the stiff metal rod 71 which at its other end is connected to a flexible hose 136 which also passes through the pump 125, so that the pump also serves to pump air into the stretchable rubber tube 133. A small air bleed hole 137 in the tube 133 serves for the air to be gradually discharged from the tube 133 so to cause the tube to contract again.

The metal rod 71 in this design includes paint passages 138 and 139 around the metal tube 135, and separated from each other by a partition 140, as shown in FIG. 15. The paint passages at one end communicate with the outlet ends of the paint hoses 43, while the other ends of the paint passages are each terminated with a nipple 141 connected to one end of an expandable accordian hose 142 which at the other end communicates with an outlet passage inside the piston.

Thus in operative use, as the piston slides back and forth, due to the changing air pressure inside the rubber tube 133, the various paints are delivered into the piston through the accordian hoses.

One outlet passage 143 inside the piston has a single outlet 144 that selectively alignes with either discharge outlet 129 on opposite sides of partition 132.

The other outlet passage 145 has two outlets 146 and 147 for selective alignment with either discharge outlet 129 on opposite sides of partition 132.

It is to be noted that when one paint is delivered into one end of the paint roller, then the other paint is delivered into the other end of the paint roller. Thus as the piston slides, different colors are reciprocally delivered into opposite ends of the paint roller, as shown in FIG. 13.

While the drawings illustrate the use of only two color paint dispensing, it is readily apparent that an apparatus may be made to accomodate dispensing three or even more different paints.

FIG. 13 also shows a rod 148 affixed at one end on a side of the nipple junction 149, the rod passing around one side of the piston and the opposite end of the rod then axially aligning with a center of the paint roller so to support the paint roller end cap 78.

It will be noted in FIGS. 13 and 14, that relief grooves 150 are provided in various portions of the pump 125 so to prevent a squeezing of the hoses at such portions. Thus an accurate sector 151 defines a portion wherein the air hose is squeezed; a sector 152 defines a portion wherein both paint hoses are squeezed; a sector 153 defines a portion where only one paint hose is squeezed, and a sector 154 defines another portion where only the other paint hose is squeezed as the roller travels by.

It should also be noted that the rollers 54 of the pump are spring loaded as shown at 155 in order to not squeeze the hoses at any moment when the piston outlets do not align with discharge ports 129, thus preventing bursting any of the air or paint lines between the pump and piston.

While various changes may be made in the detail construction, it is understood that such changes will be within the spirit and scope of the present invention, as is defined by the appended claims.

What is claimed is:

1. In a paint feeding apparatus combined with a fountain type paint roller, the combination of a paint feeding apparatus and a paint roller, said apparatus including a case on casters a tray inside said case having a pump mechanism mounted thereupon, said mechanism including an electric motor driving a pump, said tray being vertically movable for placement of a can of paint therebelow, wherein said pump including a case having a circular depression, a flexible hose means inside a periphery of said depression opposite ends of said hose means extending through grooves outward of said case, and a rotating arm having rollers at opposite ends squeezing said hose, said arm being driven from said motor wherein said paint roller includes an inner cylinder receiving paint from said hose means and outer sleeve in spaced relation around said inner cylinder, and a lambs wool around an outer side of said sleeve, openings through a cylindrical side of said cylinder for flow of said paint into a space between said cylinder and sleeve, said sleeve being perforated so said paint flows therethrough and soaks said lambs wool, wherein said arm of said pump is longitudinally adjustable by turnbuckle screw means, wherein said hose means comprises a plurality of flexible hoses adjacent each other, one said hose carrying air while a remainder of said hoses each transmit a different paint color supplied from separate paint cans, wherein also said flexible hoses communicate with a piston reciprocally slidable inside said paint roller cylinder, said piston being connected to an end of a stretchable rubber hose which communicates with said hoses said piston also having a plurality of outlets each of which communicates through an accordian expandable hose to one of said paint carrying hoses, said stretchable hose and said accordian hoses being inside said paint roller cylinder.

2. The combination as set forth in claim 1, wherein said paint roller cylinder includes a radially outward partition around a center of its outer side, dividing said space between said cylinder and sleeve into a separate chamber around each opposite end portion of said cylinder, and discharge outlets through said cylinder to each said chamber selectively aligning with said outlets of said slidable piston.

3. The combination as set forth in claim 2, wherein relief grooves are provided inside said pump aligned behind portions of said hoses for controlled release from squeezing of said hoses by a rotating arm thereof.

4. The combination as set forth in claim 3, wherein said case includes a tray supported on corner posts, each said port supporting a clamp arm bearing against an underside of one said paint can and locking said can against an underside of said tray.

5. The combination as set forth in claim 4, wherein each said post is rotatably mounted between said tray and a bottom of said case, a lower end of said post having a gear engageable with a gear on a shaft of a caster wheel on an underside of said case.

6. The combination as set forth in claim 5, wherein said caster wheel is on a caster unit that includes an elongated swivel spindle through a bottom wall of said case, a compression coil spring around said swivel spindle bearing against an underside of said case bottom wall, and said caster unit including an upward pin engaging a hole in said case bottom wall when said case is downward depressed against said compression coil spring for engaging said gears.

* * * * *